United States Patent [19]

Berchem

[11] Patent Number: 4,716,643

[45] Date of Patent: Jan. 5, 1988

[54] METHOD OF MAKING A MACHINE PART FOR ABRASIVE APPLICATIONS

[75] Inventor: Rütger Berchem, Gelsenkirchen, Fed. Rep. of Germany

[73] Assignee: Berchem & Schaberg GmbH, Gelsenkirchen, Fed. Rep. of Germany

[21] Appl. No.: 858,936

[22] Filed: Apr. 30, 1986

[51] Int. Cl.[4] ..... B23P 11/00

[52] U.S. Cl. ..... 29/434; 29/527.5; 29/DIG. 17; 29/DIG. 18; 76/101 R; 72/377; 148/325; 241/194; 241/195; 37/266

[58] Field of Search ..... 29/DIG. 17, DIG. 18, 29/434, 527.2, 527.7; 76/101 R, 107 R; 72/377; 37/266, 26.4, 108 R; 148/325; 241/194, 195; 428/593, 908.8, 910

[56] References Cited

U.S. PATENT DOCUMENTS

| | | | |
|---|---|---|---|
| 472,664 | 4/1892 | Bliss | 29/DIG. 17 |
| 1,631,623 | 6/1927 | Cochran | 29/DIG. 17 |
| 1,632,533 | 6/1927 | Brauchler | 29/DIG. 17 |
| 2,044,294 | 6/1936 | Handler | 29/DIG. 17 |
| 2,345,343 | 3/1944 | Keller | 29/DIG. 17 |
| 2,353,688 | 7/1944 | Burgess | 148/325 X |
| 2,629,923 | 3/1953 | Johnson, Jr. | 29/DIG. 17 |
| 2,822,708 | 2/1958 | Nelson | 76/107 R |
| 3,572,180 | 3/1971 | Beaumont | 76/101 R |
| 4,404,041 | 9/1983 | Akahori et al. | 148/325 X |
| 4,558,826 | 12/1985 | Martinek | 241/195 X |

FOREIGN PATENT DOCUMENTS

| | | | |
|---|---|---|---|
| 48017 | 5/1978 | Japan | 148/325 |

*Primary Examiner*—Charlie T. Moon

*Attorney, Agent, or Firm*—Karl F. Ross; Herbert Dubno

[57] ABSTRACT

A carbon steel with at least 1% by weight carbon and at least one carbide-forming alloying element such as chromium is forged into a construction machine-tool part for engagement with abrasive material, the forging provides a fiber extension direction which coincides with the principal direction of abrasive action.

2 Claims, 2 Drawing Figures

METHOD OF MAKING A MACHINE PART FOR ABRASIVE APPLICATIONS

FIELD OF THE INVENTION

My present invention relates to a method of making a machine part from a carbon steel containing a carbide-forming alloying element, e.g. chromium, for abrasive applications and to machine parts made by the method of the invention for use in abrasive applications, e.g. in construction machinery and as tool elements of construction machinery. In particular the invention relates to the use of a steel containing at least 1% by weight carbon and containing at least one carbide former for such construction machine parts and tools therefor.

BACKGROUND OF THE INVENTION

In various types of construction machinery, tools are provided which engage material to be processed, especially highly abrasive materials such as rock, stone and gravel, in a certain direction or orientation, the abrasive action of such engagement causing significant wear and detriment to the tool. A case in point is rock-breaking machinery such as hammer mills and crushers, in which the tool elements are involved in such abrasive action and are subject to such wear.

In the past, efforts have been made to fabricate these parts of such machines from extremely expensive wear-resistant steels, commonly such steels as are designated high-alloy steels and especially steel alloys rich in manganese.

These materials, however, cannot readily be forged, and therefore the machine parts must be cast in the desired configuration or in a configuration close to the desired configuration and, of course, possess a lattice, crystalline or like internal structure characteristic of such casting.

Such materials can be machined only with difficulty, tend to be somewhat brittle and when subjected to abrasive wear cannot readily be dressed.

The tool elements frequently must be machined whether for sharpening or for shaping them to a given configuration or to compensate for various factors which may be present in use of the machine. As a result, the fact that the tools are cast in forms which make machining difficult and in structures which scarcely can be machined effectively is a significant detriment. Mention should also be made of the fact that when crushing jaws or the like are fabricated from such earlier materials for use in rock-breaking machinery, they tend to have insufficient abrasion resistance as well.

OBJECTS OF THE INVENTION

It is the principal object of the present invention to provide a method which obviates the aforementioned drawbacks and permits the fabrication of a machine part without the disadvantages set forth above.

Another object of this invention is to provide a machine part which can be readily machined, has satisfactory abrasion resistance for use even in rock-crushing equipment and does not require expensive steels.

SUMMARY OF THE INVENTION

I have discovered that these objects can be attained by fabricating the machine part by forging from a steel which contains at least 1% carbon and is an alloy containing at least one carbide-forming alloying element.

Thus the invention is the use of such a steel as a material for construction machinery, machine parts and especially tools for the comminution of rock and abrasive material which comes in contact with the tool when it is used to manipulate such materials or engages the ground, with the tool being forged from the steel and having an internal fiber or grain pattern, visible by microphotography and grinding (grind-section photomicrograph) which corresponds to the main direction of abrasive action.

Preferably the carbide-forming alloying element is chromium and the chromium is present in an amount of at least 10% by weight of the composition.

The preferred composition by weight is 1.0 to 2.2% by weight carbon, 0.1 to 0.4% by weight silicon, 0.15 to 0.45% by weight manganese, 11.0 to 12.0% by weight chromium, the balance being iron and any avoidable accompanying elements which do not affect the character of the composition and can be referred to as the usual impurities.

The workpiece can be subjected to a heat treatment to increase its toughness and ductility and, notwithstanding the effective machinability of the workpiece, it is found that it has sufficient hardness and wear-resistance to be effectively used in all kinds of ground cutting or displacing construction machinery and is particularly effective as a rock-crushing tool.

Advantageously, the composition is cast into a blank which is then forged to provide the aforementioned fiber direction. According to the invention, after forging and heat treatment, machining can be effected as desired and the resulting tool is mounted on a moving part of the machine so that its orientation with respect to the attack of the surface upon the abrasive materials aligns the principal abrasive-action direction with the fiber-extension direction. The life of such a tool as a rock-breaking machine can thus be far greater than the life of a conventional tool for this purpose.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
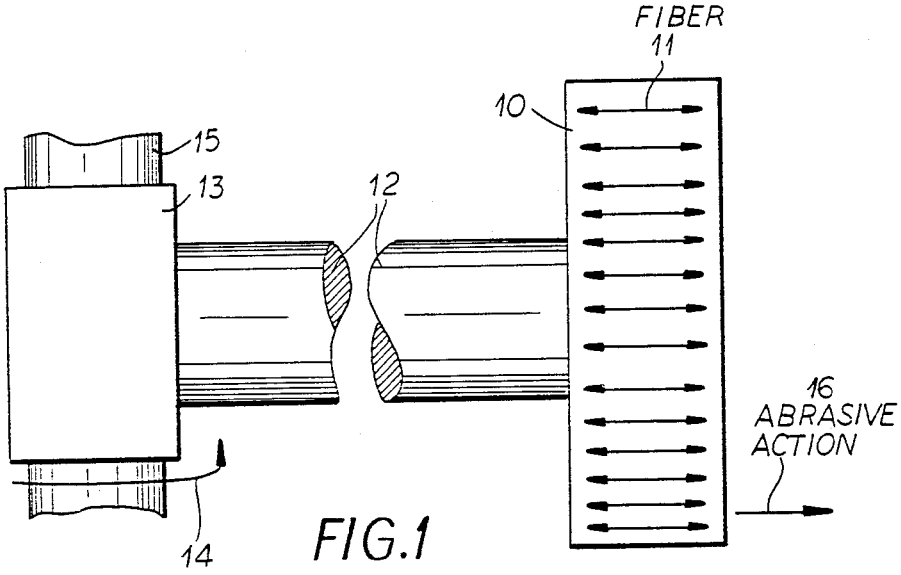
FIG. 1 is an elevational view of a T-shaped hammer mill hammer in accordance with the invention.
Figure 2:
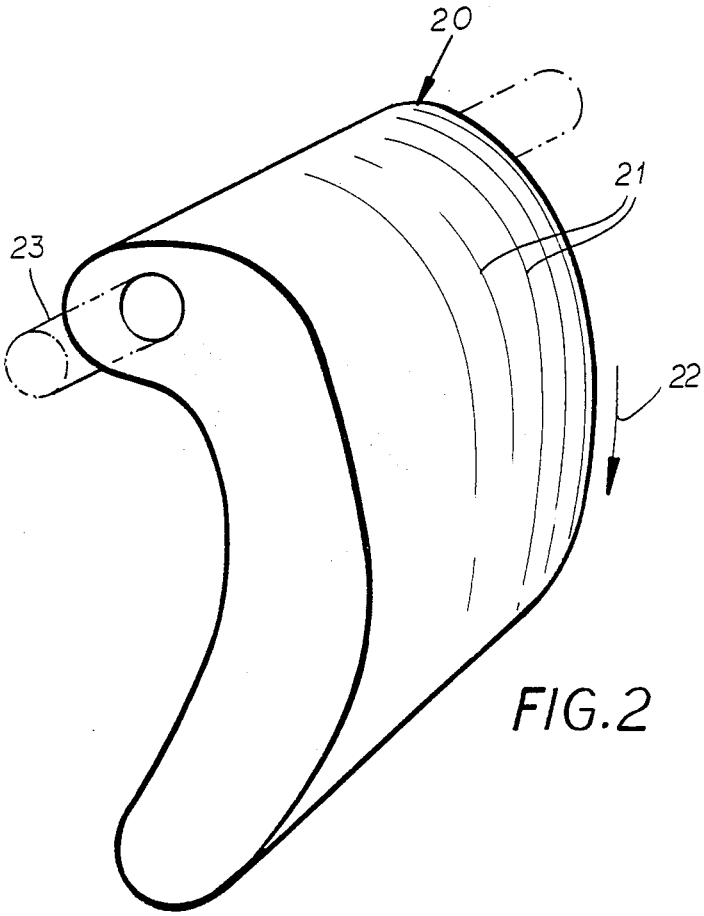
FIG. 2 is a perspective view of a rock-crusher jaw.

In FIG. 1, I have shown a hammer mill hammer which has at least its head 10 forged from a steel composition, e.g. the composition of the example given below, the forging direction being such to create a fiber pattern in which the fibers are oriented and elongated in the direction represented by the arrows 11.

The head 10 is formed unitarily with a shank 12 connected to the eye 13 by which, after forging, the hammer is mounted so as to swing (arrow 14) on an orbiting shaft 15 of the hammer mill. The abrasive action is represented by the arrow 16 and can be seen to coincide with the fiber pattern direction.

Similarly, when a crusher jaw 20 for a rock crusher is forged, the fiber pattern represented at 21 can be oriented to run parallel to the main abrasive-action direction represented by the arrow 22 when the jaw is mounted on the movable machine part 23.

SPECIFIC EXAMPLE

A steel composition of 1.5% by weight carbon, 0.25% by weight silicon, 0.30% by weight manganese and 11.5% by weight chromium, the balance being iron with a maximum of 0.040% by weight phosphorous and 0.050% by weight sulphur, is cast and forged in the manner described using conventional hot-forging techniques to obtain the fiber elongation orientation as described. To increase its toughness, after forging, the steel is held at about 800° C. for several hours and then slowly cooled.

The workpiece is then mounted so that its fiber-elongation direction is generally parallel to the direction of abrasive action on the moving machine part upon which it is to be carried.

I claim:

1. A method of making a machine part of a given configuration adapted to engage an abrasive material in a certain orientation of said machine part upon movement of a machine element relative to said material, said method comprising the steps of:

casting a carbon steel body from a steel composition consisting essentially of:

1.0 to 2.2% by weight carbon, 0.1 to 0.4% by weight silicon, 0.15 to 0.45% by weight manganese, 11.0 to 12.0% by weight chromium, the balance iron and the usual and unavoidable accompanying elements;

forging said body into said configuration with a fiber structure running parallel to the direction with which said machine part would engage said material if oriented in said orientation to form the machine part; and affixing the forged machine part to said element in said orientation whereby the machine part affixed to said element engages said material so that at least a principal direction of abrasive attack upon said machine part is parallel to said fiber structure.

2. The method defined in claim 1 further comprising heat treating the forged part to impart increased toughness and ductility thereto.

* * * * *